United States Patent [19]

Horvath

[11] 4,053,262

[45] Oct. 11, 1977

[54] AQUARIUM PUMP STRUCTURE

[75] Inventor: Tibor Horvath, Brooklyn, N.Y.

[73] Assignee: Aquology Pet Corporation, Newark, N.J.

[21] Appl. No.: 726,932

[22] Filed: Sept. 27, 1976

[51] Int. Cl.[2] ..... F04B 17/00; E04H 3/16

[52] U.S. Cl. ..... 417/424; 210/169; 415/201; 415/215; 417/360

[58] Field of Search ..... 415/215, 201; 417/423 A, 424, 360; 210/169

[56] References Cited

U.S. PATENT DOCUMENTS

| | | | |
|---|---|---|---|
| 3,225,930 | 12/1965 | Willinger | 417/424 |
| 3,468,288 | 9/1969 | Cassil | 210/169 |
| 3,566,840 | 3/1971 | Willinger | 210/169 |
| 3,701,427 | 10/1972 | Howard | 210/169 |
| 3,744,635 | 7/1973 | Horvath | 210/169 |

*Primary Examiner*—C. J. Husar

*Attorney, Agent, or Firm*—Peter L. Tailer

[57] ABSTRACT

A motor mounting element of an aquarium pump mounts the pump motor and nests over the pump housing to position the motor over the housing and hold the housing together. Locking lugs on the motor mounting element orient the assembled parts of the housing to position the pump outlet in a desired direction.

8 Claims, 4 Drawing Figures

AQUARIUM PUMP STRUCTURE

BACKGROUND OF THE INVENTION

1. Field of the Invention

This invention relates to aquarium pump construction.

2. Description of the Prior Art

Aquarium pump housings are conventionally bolted, screwed, or glued together. The motor mounting bolts often extend into the pump housing to come in contact with pumped water.

SUMMARY OF THE INVENTION

An aquarium pump has a housing with a large diameter upper chamber having a top wall containing an aperture and a smaller diameter lower chamber containing an inlet. The housing also has a tangential outlet from the upper chamber and the pump has an impeller in the chambers having a larger upper portion in the upper chamber and a smaller lower portion extending down into the lower chamber. A motor is mounted above the housing and has a shaft extending downward through the aperture in the top wall to rotate the impeller within the housing. Seal means are disposed about the shaft adjacent to the aperture to prevent air or water leakage through the aperture. The upper chamber has a seperate lower portion formed integrally with the lower chamber and a separate upper portion formed integrally with the top wall. A motor mounting element has the motor fixed to it. It serves two functions in that it nests over the upper chamber to position the motor over the housing and it holds the two elements of the housing together by means of a skirt which extends downward below the lower portion of the upper chamber to terminate in locking lugs which rotate under corresponding locking lips of the lower portion of the housing.

The motor mounting mounts the motor over the housing without the need for metal mounting bolts extending into the upper chamber. This prevents corrosion of the mounting bolts and it makes the assembly of the pump much easier. In addition, the motor mounting element enables the pump outlet to be directed in desired directions. The specific pump structure of this invention allows the pump to be made entirely in two part molds with the exception of one cam action to form the tangential outlet. An integrally formed lock is provided on one lip to fix the assembled housing elements against relative rotation.

DESCRIPTION OF THE PREFERRED EMBODIMENT

Figure 1:
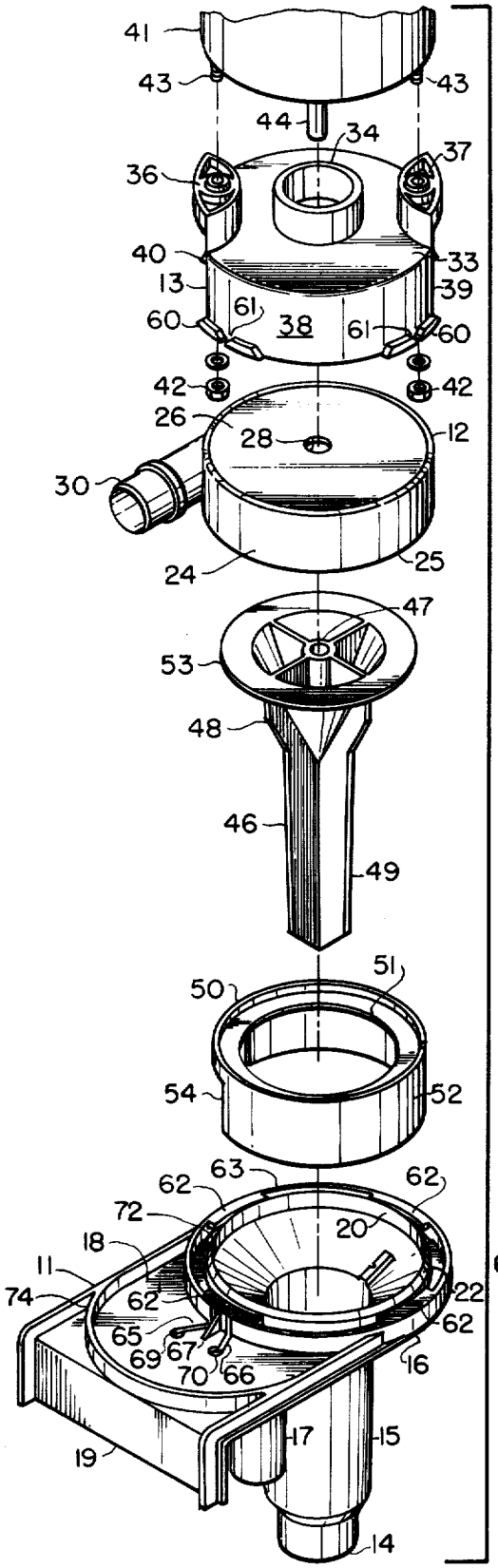
FIG. 1 is an exploded, perspective view of the elements of an aquarium pump according to this invention.
Figure 2:
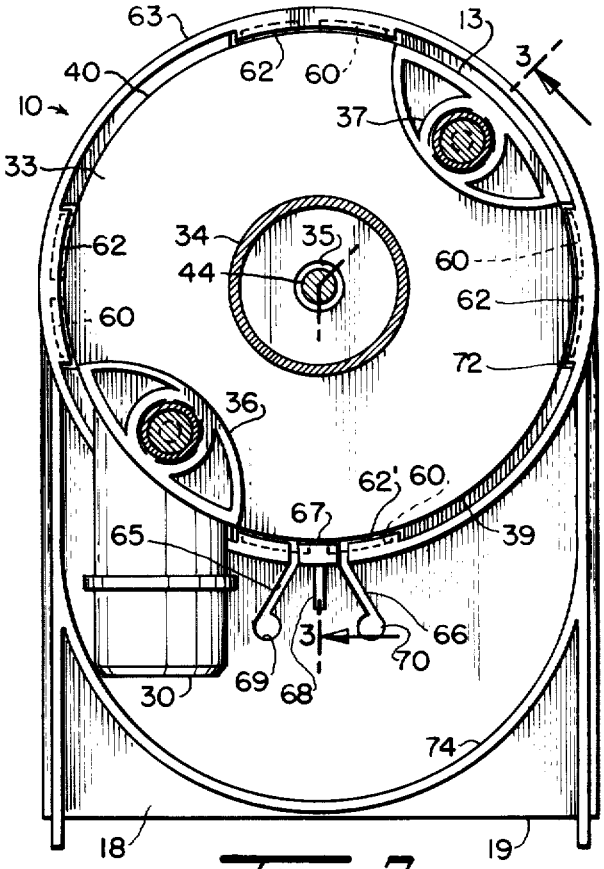
FIG. 2 is a horizontal section through the upper portion of the aquarium pump taken on line 2—2 of FIG. 3.
Figure 3:
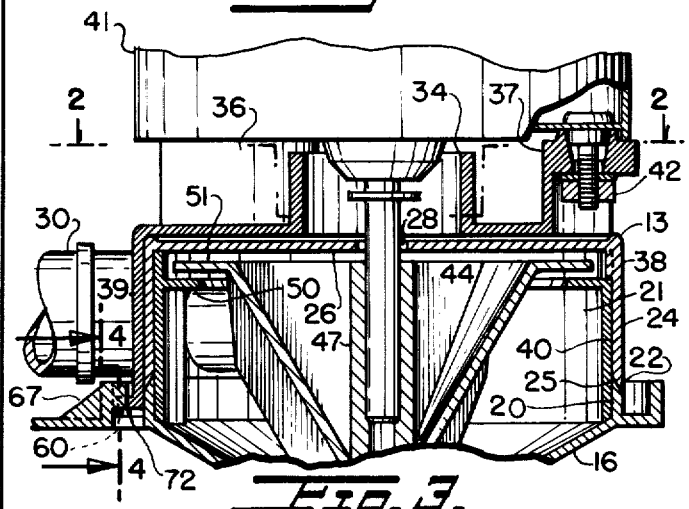
FIG. 3 is a section taken on line 3—3 of FIG. 2.

As shown in FIGS. 1 and 3, the aquarium pump of this invention has a hollow housing 10 formed of three parts, a lower portion 11, an upper portion 12, and a motor mounting element 13. The lower portion 11 contains an inlet 14 to a lower chamber 15 which extends upward to an outward flare 16. A bypass outlet 17 extends downward adjacent to chamber 15. From the outward flare 16 a mounting shelf 18 extends laterally to the lip 19 which hooks over a tank rim (not shown) to secure the pump in place. Lower portion 11 has the bottom portion 20 of upper chamber 21 formed integrally with it above the outward flare 16. Bottom portion 20 terminates in the beveled edge 22.

Upper portion 12 has a cylindrical wall 24 with a lower edge 25 beveled to correspond to edge 22. Upper portion 12 has a top wall 26 and forms the large diameter upper chamber 21. Top wall 26 contains a central aperture 28 and a tangential outlet tube 30 extends from wall 24.

Referring additionally to FIG. 3, motor mounting element 13 has a top wall 33 with a central boss 34 containing an aperture 35 and two mounting flanges 36 and 37. A skirt 38 extends downward in two opposite sectors or cylindrical wall portions 39 and 40 from top wall 33. A motor 41 is bolted to flanges 36 and 37 by nuts 42 turned onto the projecting mounting bolts 43. Motor shaft 44 extends through aperture 35.

The elements in addition to the above which assemble into the aquarium pump of this invention include the impeller 46 which has a hub 47 to receive motor shaft 44 with a hand inserted press fit. Impeller 46 has a large upper portion 48 in upper chamber 21 and a smaller lower end 49 which extends into the smaller diameter lower chamber 15.

A dynamic seal element 50 has a horizontal annular shelf 51 and a cylindrical wall 52 to a position shelf 51 vertically in chamber 21. An opening 54 in wall 52 allows fluid in upper chamber 21 access to outlet tube 30. Shelf 51 is disposed under rim 53 which is formed at the top of impeller 46 to set up conditions so that centrifugal force keeps water away from opening 28 in top wall 22 and forms an annular water barrier to prevent air from being drawn into chamber 21 through opening 28. This particular structure forms a dynamic seal about shaft 44. If desired, a conventional rubber grommet (not shown) can be used to seal shaft 44 and element 50 would not then be required.

Motor mounting element 13 mounts motor 41 as has been described. The lower edges of sectors 39 and 40 have four sets of outwardly facing pairs of lugs 60 formed integrally with them. Each pair of lugs 60 has a gap 61 therebetween. Four lips 62 and 62′ jut inward from a rim 63 formed on lower portion 11 so that downward movement and then rotation of motor mount element 13 slides lugs 60 under the lips 62 and 62′. Since upper portion 12 nests within motor mounting element 13, this locks the pump housing together.

Figure 4:
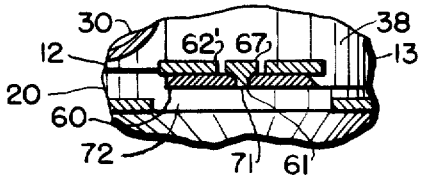
FIG. 4 is a vertical section taken on line 4—4 of FIG. 3.

One lip 62′ is disposed on shelf 18 and has two converging slots 65 and 66 formed in it and in shelf 18 to isolate and resiliently mount center portion 67 of lip 62′. A reinforcing flange 68 and stress relief holes 69 and 70 should be provided. As shown in FIG. 4, a downward extension or detent 71 snaps between a pair of lugs 60 into a gap 61 to lock the motor mounting element 13 and outlet tube 30 in any one of four desired positions.

The structure of the pump of this invention has several advantages. Since the upper chamber 21 of housing 10 must be substantially the diameter of motor 41, the motor mounting bolts 43 in conventional practice would have to extend into chamber 21 to be fastened with nuts 42. This destroys smooth flow in chamber 21 to reduce pump capacity, the chamber 21 may leak where pierced by the bolts 43, and the metal bolts and nuts 43 and 42 corrode in contact with aquarium water. Since motor mounting element 13 receives the bolts 43, this solves these problems as well as making the nuts 42 easily accessible. Motor mounting element 13 also assembles and holds together lower portion 11 and upper portion 12 in such a manner that the pump can be easily disassembled for cleaning without tools. Any fluid leakage past the mating edges 22 and 25 runs down to be contained by rim 63 and drain into the filter tank (not shown) throught the openings 72 under the lips 62 and 62'. If any fluid drips on shelf 18, it is contained thereon by barrier rib 74 and drains through the stress relief holes 69 and 70 and slots 65 and 66.

I claim:

1. An aquarium pump having a housing with a large diameter upper cylindrical chamber having a top wall containing an aperture, a smaller diameter lower chamber containing an inlet, an outward flare between said lower chamber and said upper chamber, and a tangential outlet leading from said upper chamber, and a tangential outlet leading from said upper chamber, an impeller within said chambers of said housing having a larger portion in said upper chamber and a smaller portion extending downward into said lower chamber, a motor disposed over said housing having a shaft extending through said aperture in said top wall and mounting said impeller, and seal means disposed about said shaft adjacent to said aperture in said top wall; the improvement comprising, in combination, an upper portion of said housing including said top wall of said housing and at least part of said upper chamber, a lower portion of said housing extending downward below said upper portion of said housing, mating edges of said upper and lower portions of said housing, a motor mounting element having a top wall containing a central opening and having mounting flanges to which said motor is fixed with said motor shaft extending downward through said opening, skirt elements extending downard about said top wall of said motor mounting element, said top wall of said motor mounting element and said skirt elements nesting about said upper chamber, locking lugs projecting outwards from said skirt elements, and inwardly facing locking lips formed on said lower portion of said housing so that rotating said motor mounting element moves said lugs under said lips fixing said motor over said housing and holding said upper and lower portions of said housing together.

2. The combination according to claim 1 wherein said locking lugs and said lips are positioned equidistantly about said motor mounting element and said upper chamber, said upper portion of said housing includes said outlet tube, and said outlet tube projects between said skirt elements, said outlet tube being directed by the angular positioning of said motor mounting element.

3. The combination according to claim 2 wherein saidmating edges are beveled.

4. The combination according to claim 2 wherein there are four of said locking lugs and four of said locking lips.

5. The combination according to claim 4 with the addition of a rim integrally formed with said lower portion of said housing and disposed about said upper chamber, said lips extending inward from said rim and said lower portion of said housing having openings under said lips within said rim.

6. The combination according to claim 5 wherein each of said locking lugs is a pair of locking lugs havinng a gap therebetween, said lower portion of said housing has a mounting shelf extending laterally from one side of said rim, and one of said lips contains a pair of slots resiliently mounting a portion of said one of said lips; and with the addition of a detent extending below said resiliently mounted portion of one of said lips, said detent extending into one of said gaps between a pair of said lugs locking said motor mounting element against rotation.

7. The combination according to claim 6 with the addition of a barrier rim on said mounting shelf, and wherein said pair of slots extends through said rim into said mounting shelf, said barrier rim extending about said slots containing fluid leaking onto said mounting shelf to drain through said slots.

8. The combination according to claim 7 wherein said slots terminate in stress relief apertures through which fluid on said mounting shelf also drains.

* * * * *